US008256237B2

(12) United States Patent
Bischofberger et al.

(10) Patent No.: US 8,256,237 B2
(45) Date of Patent: Sep. 4, 2012

(54) REFRIGERATING DEVICE WITH CIRCULATING AIR COOLING SYSTEM

(75) Inventors: Thomas Bischofberger, Kißlegg (DE); Fritz Hägele, Herbrechtingen (DE); Hans Ihle, Giengen (DE); Andreas Kempte, Giengen (DE); Frank Placke, Bielefeld (DE); Rainer Spaag, Ellangen-Röhlingen (DE); Matthias Stahl, Schloß Holte-Stukenbrock (DE); Ulrich van Pels, Rheda-Wiedenbrück (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 638 days.

(21) Appl. No.: 12/525,567

(22) PCT Filed: Jan. 17, 2008

(86) PCT No.: PCT/EP2008/050495

§ 371 (c)(1),
(2), (4) Date: Aug. 3, 2009

(87) PCT Pub. No.: WO2008/095754

PCT Pub. Date: Aug. 14, 2008

(65) Prior Publication Data

US 2010/0089089 A1 Apr. 15, 2010

(30) Foreign Application Priority Data

Feb. 6, 2007 (DE) ..... 10 2007 005 953

(51) Int. Cl.
*F25D 17/06* (2006.01)

(52) U.S. Cl. ..... 62/186; 62/407; 62/419

(58) Field of Classification Search ..... 62/180, 62/186, 404, 407, 408, 419, 440, 441
See application file for complete search history.

(56) References Cited

U.S. PATENT DOCUMENTS

| | | | | |
|---|---|---|---|---|
| 4,920,765 | A * | 5/1990 | McCauley et al. | 62/408 |
| 5,758,512 | A * | 6/1998 | Peterson et al. | 62/407 |
| 5,918,480 | A | 7/1999 | Nagata et al. | |
| 2004/0060319 | A1 * | 4/2004 | Wood | 62/441 |
| 2006/0005567 | A1 | 1/2006 | Lee et al. | |

FOREIGN PATENT DOCUMENTS

| | | | |
|---|---|---|---|
| DE | 102005021560 | A1 | 11/2006 |
| JP | 5-157443 | A | 6/1993 |
| JP | 2001-174136 | A | 6/2001 |

* cited by examiner

*Primary Examiner* — Marc Norman
(74) *Attorney, Agent, or Firm* — James E. Howard; Andre Pallapies

(57) ABSTRACT

A refrigerating device is provided that includes an evaporator and a compartment that is cooled by air circulating air from and to the evaporator, wherein a diffusion layer can be displaced between a first position, in which air passage openings distributed in a wall separating the compartment from a distribution chamber are covered by the diffusion layer, and a second position, in which the diffusion layer is positioned so as to allow air to flow from the evaporator through the distribution chamber into the compartment while bypassing the diffusion layer.

15 Claims, 4 Drawing Sheets

REFRIGERATING DEVICE WITH CIRCULATING AIR COOLING SYSTEM

BACKGROUND OF THE INVENTION

The present invention relates to a refrigerating device with circulating air cooling system and at least one compartment cooled by circulating air from and to the evaporator. In a refrigerating device of this type known from DE 10 2005 021 560 A1 a distribution chamber of formed adjacent to the cooling compartment which is separated from said compartment by a perforated wall. The holes can be covered on the distribution chamber side by a fleece in order to prevent a fierce stream of cold air from the distribution chamber hitting sensitive cooled items in the compartment and drying them out. The airflow slowed down by the diffusion layer can however result in condensation water only being removed inadequately from the compartment. Thus the cooled items sensitive to an excess of moisture can become soaked in the compartment, which is also not desired.

BRIEF SUMMARY OF THE INVENTION

The object of the present invention is to create a refrigerating device with a circulating air cooling system which allows good storage conditions to be created for cooled items sensitive to drying out or for cooled items sensitive to moisture.

The object is achieved inventively for a refrigerating device with an evaporator and at least one compartment cooled by air circulation from and to the evaporator, in which air passage openings distributed in a wall separating the compartment from a distribution chamber are covered by a diffusion layer in a first position, by the diffusion layer being able to be moved into a second position in which it makes possible a flow of air from the evaporator through the distribution chamber into the compartment while bypassing the diffusion layer.

The diffusion layer can be a thin layer of porous foam plastic or preferably be made from a loose fiber material If an air inlet opening is formed in a wall of the distribution chamber adjacent to the dividing wall, the diffusion layer can be displaced from the dividing wall in its second position, to make possible a free air circulation from the air inlet opening to the air passage openings.

To ensure the movability of the entire diffusion layer in one piece, this can be attached to a movable frame.

Preferably this frame has openings which in the first position are flush with the air passage openings. Thus the frame can lie flat against the dividing wall in the first position without disturbing the flow of the air from the distribution chamber into the compartment.

In accordance with a first preferred embodiment the frame is able to be pivoted around an axis. The axis is preferably parallel to the dividing wall.

In accordance with a second embodiment the frame can be able to be moved on a ramp aligned at an angle to the dividing wall.

An actuation section of the frame used to drive its movement can be adjustable by a movable ramp.

In accordance with an especially preferred embodiment the refrigerating device features at least two compartments adjoining the dividing wall, with each compartment being assigned a diffusion layer that can be moved between the first and the second position independently of the diffusion layer assigned to the other compartment in each case. Thus favorable conditions can be created in a first of the compartments for cooled items sensitive to dry conditions, while simultaneously suitable conditions can be created in the second compartment for cooled items sensitive to moisture, or vice versa, or the same conditions can be provided in both compartments.

With such a refrigerating device with two compartments the frame of each diffusion layer is preferably assigned a movable ramp. The movable ramps can be rigidly connected to each other so that a single drive mechanism is sufficient for defining the position of both diffusion layers.

In particular a motor can be provided for driving each movable ramp.

A control device can be provided to control such a motor, featuring a user interface for specifying the type of cooled items stored in each compartment and being configured to select the position of the diffusion layer in each case on the basis of the type of cooled items.

Preferably the distribution chamber is accommodated in a dividing wall between the compartment ventilated by air from the distribution chamber (or compartments to which this air is supplied) on the one hand and a further compartment of the refrigerating device on the other hand.

BRIEF DESCRIPTION OF THE DRAWINGS

Further features and advantages of the invention emerge from the description of exemplary embodiments given below which refer to the enclosed figures. The figures show.

DETAILED DESCRIPTION OF EXEMPLARY EMBODIMENTS OF THE PRESENT INVENTION

Figure 1:
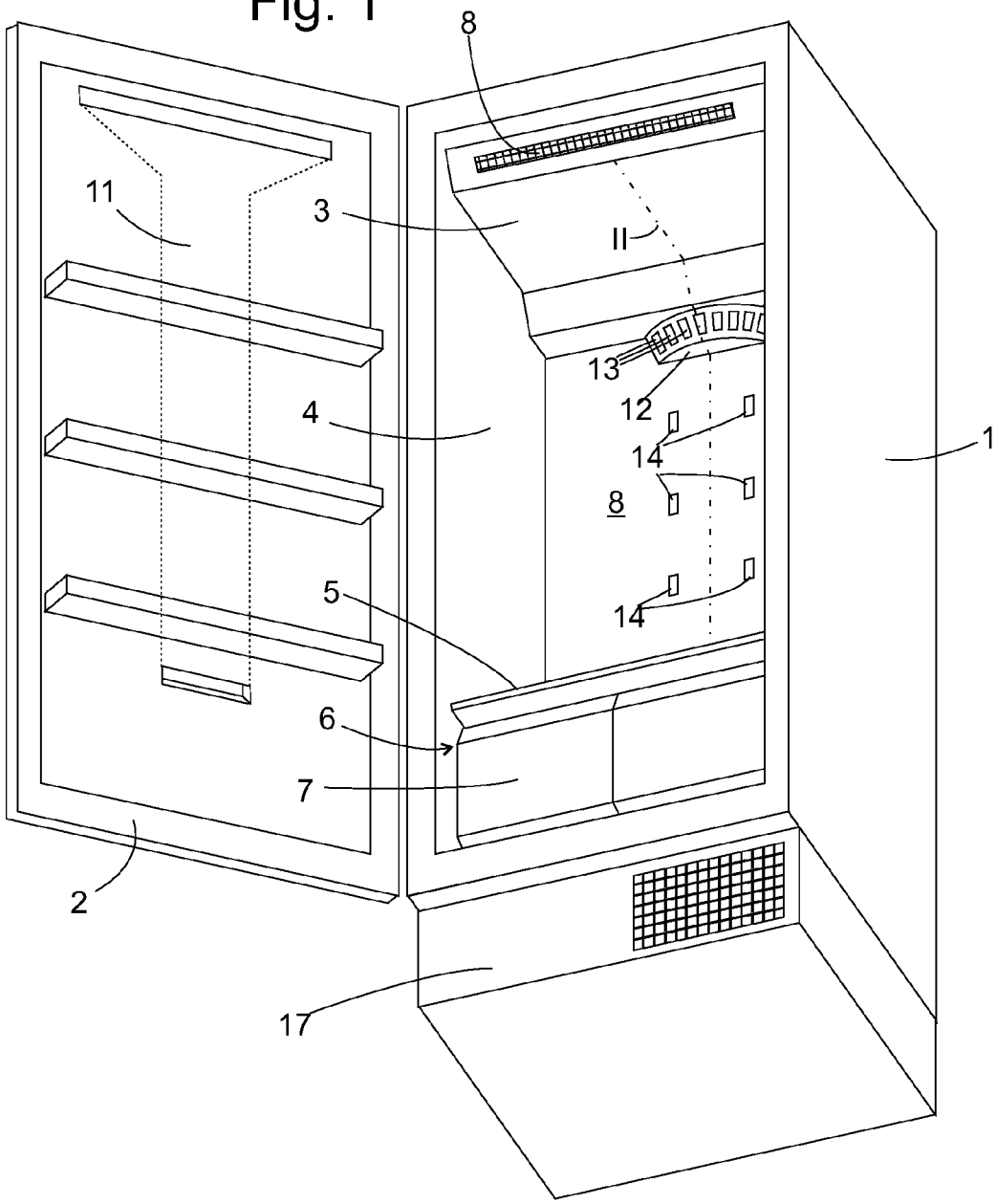
FIG. 1 a perspective view of an inventive refrigerating device.

FIG. 1 shows a perspective view at an angle from below of a refrigerating device with reference to which the present invention is to be explained. The device has a carcass 1 and a door 2 closing onto it. The inside of the carcass 1 is divided into an evaporator area 3 at the top below the roof of the carcass 1, a first cooling area 4, and separated from this by an insulating dividing wall 5, a second cooling area 6. The second cooling area 6 is divided into two compartments by pull-out drawers 7 arranged next to each other. The first cooling area 4 is normally divided by a number of cooled item carriers into compartments lying above one another. These cooled item carriers are omitted in FIG. 1 since they are not of importance for the current invention.

Formed on the front side of a dividing wall 9 separating the evaporator area 3 from the first cooling area 4 (see FIG. 2) is an air inlet opening 10 through which air can enter from the first cooling area 4 into the evaporator area 3. Lines through which air can flow from the second cooling area 6 to the evaporator area 3 can—not visible in FIG. 1—run in the side walls of the carcass 1; another option indicated in FIG. 1 is an air line 11 in the inside of the door 2 which begins at the height of the second cooling area 6 and ends opposite the air inlet opening 10, and the course of which is shown in the figure by dashed lines.

Attached adjacent to the rear wall 8 of the carcass 1 is a distribution cowl 12 on which a plurality of air holes 13 is formed, through which the cooling air coming from the evaporator area 3 is distributed in the upper part of the first cooling area 4 in various directions. Located on the rear wall 8 below the distribution cowl 12 are several pairs of openings 14 out of which cooling air can also flow. The height of these pairs of openings 14 is selected so that when cooled item carriers are installed in the first cooling area 4, each pair of openings 14 supplies a compartment delimited by the cooled item carriers.

Figure 2:
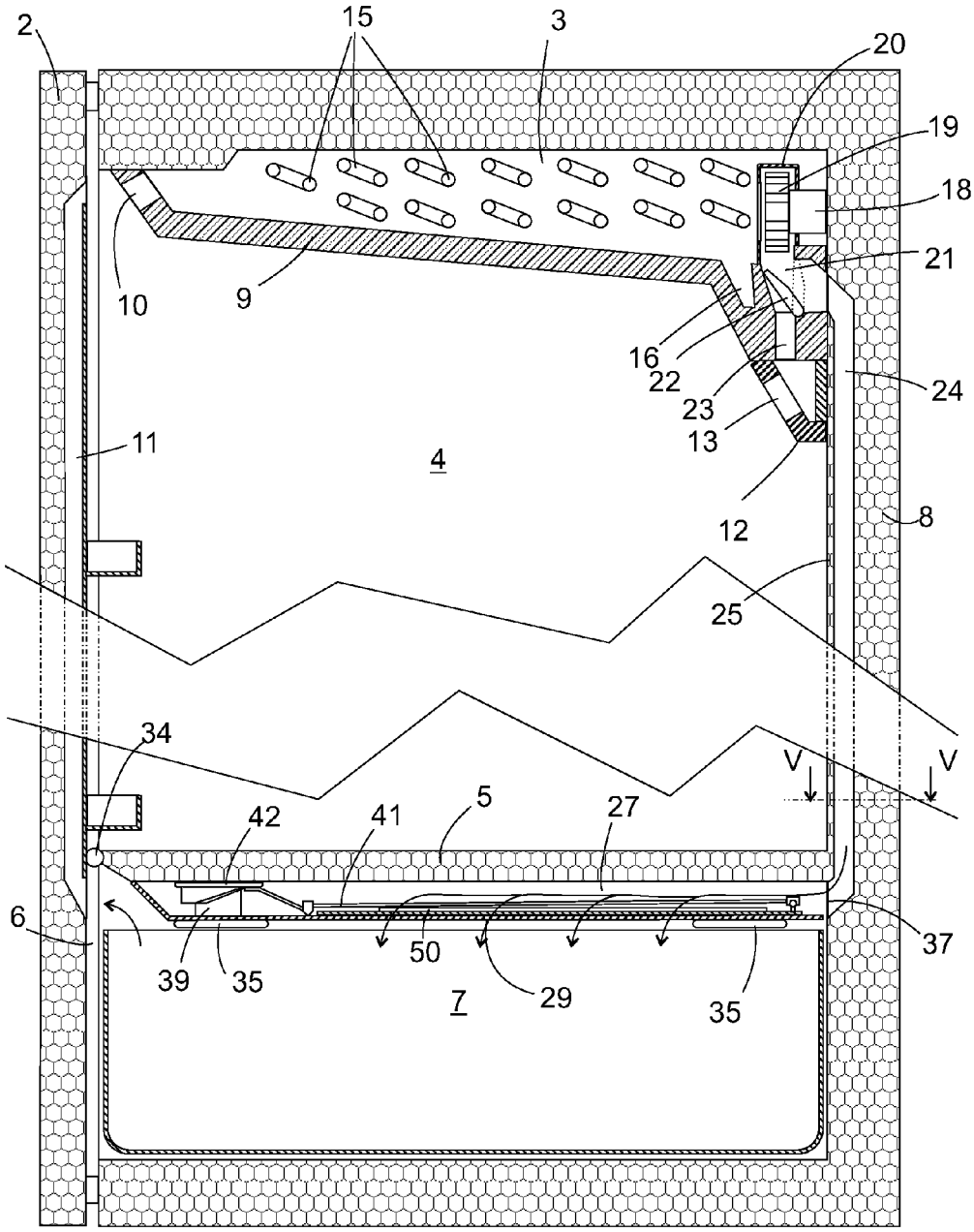
FIG. 2 a section through the refrigerating device depicted in FIG. 1 along the line II from FIG. 1.

FIG. 2 shows the refrigerating device of FIG. 1 in a section along a plane extending vertically and in the downwards direction of the carcass 1, which is shown in FIG. 1 by a dotted and dashed line II. Cooling loops of an evaporator 15 are to be seen inside the evaporator area 3 in the sectional view through which the air penetrating through the air inlet opening 10 flows. The dividing wall 9 slopes down in relation to the rear wall of the carcass 1 into a channel 16 in which the condensation water dropping off the evaporator 15 collects. The condensation water reaches a condenser housed in the base area 17 (see FIG. 1) of the carcass 1 via a pipe not shown in the diagram.

Accommodated beyond the channel 16, adjacent to the rear wall 8, is a fan which comprises a motor 18, a blade wheel 19 driven by said motor and housing 20. On the front side of the housing 20, in the axial direction of the blade wheel 19, is formed an induction opening. The upper half of the housing 20 runs in the circumferential direction closely around the blade wheel 19; the housing 20 is open at the bottom so that a rotation of the blade wheel 19 causes air accelerated radially outwards to flow down into a chamber 21.

Accommodated in this chamber 21 is a hingeable flap 22. In the position shown in the figure the flap 22 blocks a cold air supply opening 23 which leads vertically downwards to the first cooling area 4. This means that the air is forced out towards the rear wall 8 and into a cold air supply path 24 which leads within the rear wall 8 from the first cooling area 4, separated by a thin insulation layer 25, to the second cooling area 6. If the flap 22 hinged on a dividing wall 26 between the cold air supply opening 23 and the cold air supply line 24 is put into a vertical position, shown the figure as a dotted outline, it blocks the cold air supply path 24 and the cold air flow reaches the distribution cowl 12 through the cold air supply opening 23. One of the air holes 13 can be seen in the section depicted in FIG. 2, through which the air flows out from the distribution cover 12 into the first cooling area 4.

The cold air supply path 24 leads to a distribution chamber 27 which extends into the dividing wall 5 separated from the first cooling area 4 by an insulation layer, above the second cooling area 6. Arranged between the distribution chamber 27 and the second cooling area 6 is a horizontal partition wall 29. It is provided with a plurality of openings 30 (see FIG. 3) via which the distribution chamber 27 distributes cooled air supplied via the supply path 24 and an air inlet opening 37 formed on the narrow side of the distribution chamber 27 over a large area into the cooling area 6 or the pull-out 7 compartments open to the top accommodated within it.

From the cooling area 6, air flows via the air line 11 formed in the door 2 back into the evaporator area 3. To prevent an uncontrolled transfer of air between the cooling areas 4, 6 at different temperatures, the dividing wall 5 has a sealing profile 34 on its leading edge lying against the door 2.

The partition wall 29 can be installed in the carcass 1 so that it can be removed, by for example, as shown in FIG. 2, resting on bars 35 projecting from the side walls of the carcass 1. Thus by removing the partition wall 29 the volume of the distribution chamber 27 can also be used if need be to store cooled items.

Figure 3:
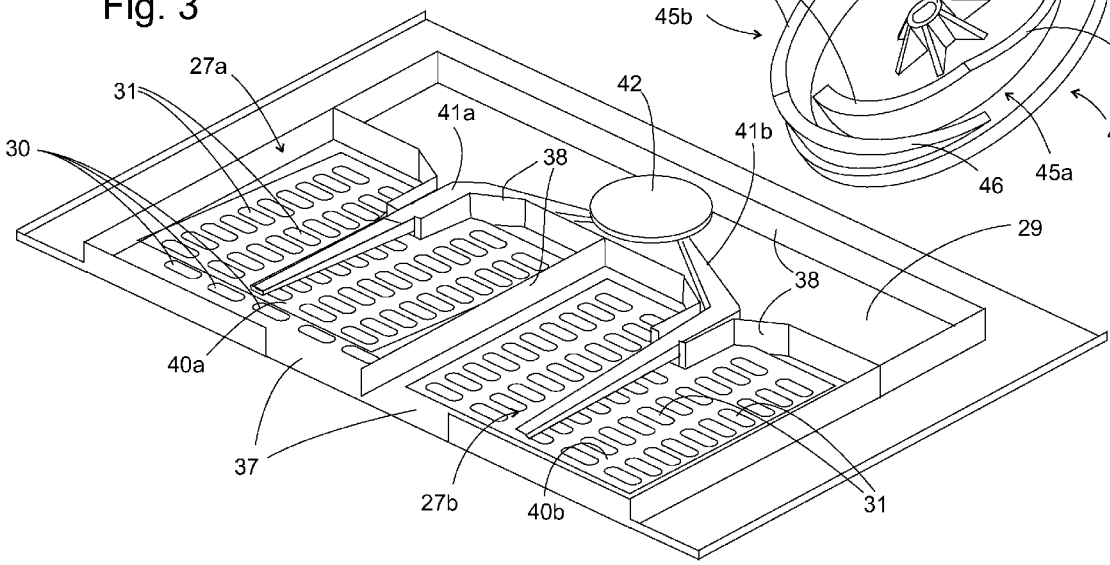
FIG. 3 a perspective view of the wall dividing the compartment and distribution chamber and of items installed on it.

FIG. 3 shows a perspective view of the partition wall 29 seen from the direction of the distribution chamber 27. Vertical bars 38 projecting from the partition wall 29 divide the distribution chamber 27 into two part chambers 27*a*, 27*b*, one of which lies above one of the two pullout drawers 7 and the other above the other pull-out drawer 7 in each case. In the right-hand part chamber 27*b* a plate 40*b* with many breakthroughs is shown lying flat on the partition wall 29. Openings 31 of the plate 40*b* coincide with the openings 30 of the partition wall 29 lying below them in each case so that the plate 40*b* does not impede the air flow from the part chamber 27*b* into the pull-out drawer 7 lying below it.

The plates 40*a*, 40*b* are intended to carry in each case a flat fleece 50 not shown in FIG. 3 which covers them and lets air pass through (see FIG. 2) which covers all the openings 31 of the plates 40*a*, 40*b*. The fleece 50 ensures, in the position shown for the plate 40*b*, an even distribution of the air to the openings 13 of the partition wall 29 and a slow even flow of air which acts on the compartment or pull-out drawers 7 lying below it, but still only has a slight drying effect.

The plates 40*a*, 40*b* are suspended at their edge facing towards the rear wall 8 or the air inlet opening 37 in each case from a free end of a two-arm pivot lever 41*a*, 41*b*. The pivot arms 41*a*, 41*b* are—controlled by a control unit 42 shown in greater detail in conjunction with FIG. 4—able to be pivoted around an axis which runs approximately at the height of the door-side edges of the plates 40*a*, 40*b* in parallel to these edges. If an opposing free end of one of the pivot levers 41 is pressed down by the control unit 42, as shown in the figure, using the left-hand pivot arm 41*a* as an example, this lifts the associated plate, in this case the plate 40*a* at its edge adjacent to the air inlet opening 37, so that air flows from the air inlet opening 37 into an intermediate space narrowing in the shape of a wedge in relation to the door between the plate 40*a* and the partition wall 29 and flows through the opening 30 of the partition wall into the pull-out drawers 7 located below it. Since in this case the air flow is not attenuated by the fleece 50, the flow speed into the pull-out drawer located below 7 is higher than when the plate is lowered, so that the supplied air has a far greater drying-out effect in the pull-out drawer 7.

Figure 4:
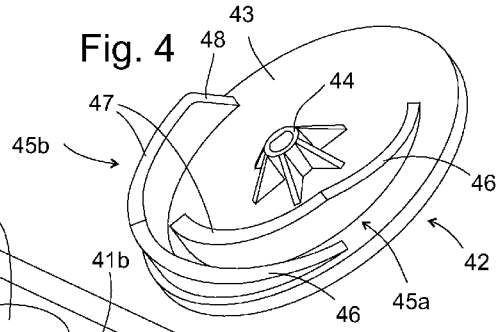
FIG. 4 a perspective view of a control disk.
Figure 5:
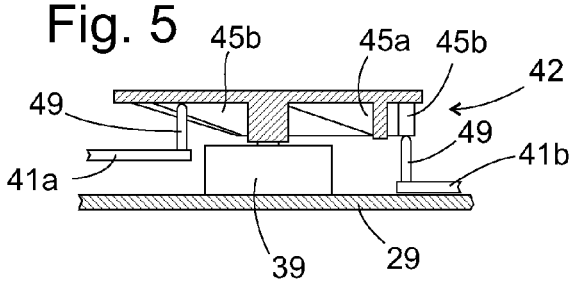
FIG. 5 a section through the control disk and its environment.

FIG. 4 shows a perspective view of the underside of the control element 42 hidden from view in FIG. 3. The control element 42 comprises a circular base plate from which a non-round boss 44 projects, which is intended to accept the shaft of an electric motor 39 not shown in the figure, hidden in FIG. 3 below the control element 2 (see FIG. 2 or FIG. 5). Arranged concentric to the boss 44 at different radiuses are two ramps 45*a*, 45*b*. Each of these ramps is intended to interact with one of the two pivot levers 41*a*, 41*b* engaging under the base plate. The two ramps 45*a*, 45*b* each have a gently rising flank 46, a top section 47 of constant height and a sharply falling flank 48. As can be seen in the cross section depicted in FIG. 5, the pivot levers 41*a*, 41, at their free ends interacting with the control element 42, each have an upright pin 49, which makes it possible for one of the pivot levers, the left lever 41*a* in the diagram depicted in FIG. 5, to come into contact with the control element on the radius of the inner ramp 45*a*, without coming into contact with the outer ramp 45*b* in doing so.

The result of the two ramps being suitably offset at an angle from each other means that there is a position of the control element 42 in each case in which the pins 49 of the two pivot levers 41*a*, 41*b* touch the base plate 43, a position in which one pin 49 touches the top section 47 of the ramp 45 while the other pin 49 touches the base plate, a position in which both pins 49 touch the respective top section 45*a* or 45*b* of the ramp assigned to them as well as a position in which one pin 49 touches the top section of the ramp 45*b* while the other touches the base plate 43. Expediently the positions follow each other in the stated sequence during a rotation of the control element 42. The direction of rotation of the motor 39 is selected so that the pins 49 glide in each case along the gentle flanks 46 to the top section 47 and subsequently fall back along the steep flanks 48 to the base plate 43. The fact that the flanks 48 are kept steep means that on the one hand the angle intervals at which one of the four positions is present can be made large so that only a small degree of precision is required in the control of the angle of rotation of the control element 42, whereas on the other hand the gentle rise of the flanks 46 makes it easier for the pins 49 to slide onto the ramps 45*a*, 45*b* and facilitates the associated lifting of the plates 40.

Figure 6:
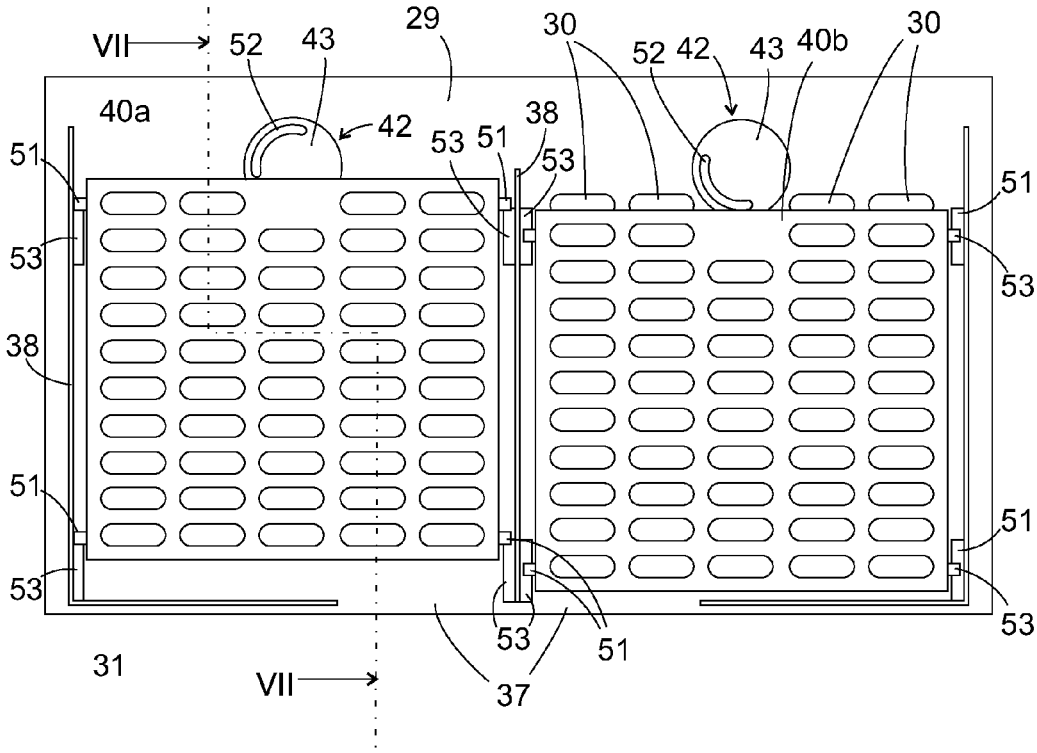
FIG. 6 an overhead view of a wall separating distribution chamber and compartment, seen from the side of the distribution chamber, in accordance with a second embodiment of the invention.
Figure 7:
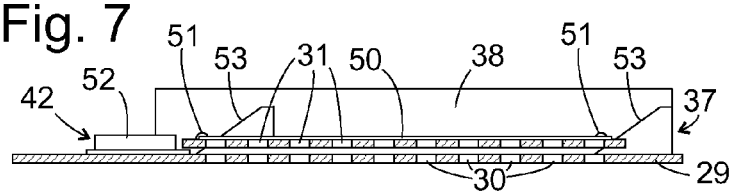
FIG. 7 a section through the wall depicted in FIG. 6.

A second embodiment of the partition wall 29 and of parts mounted on it is shown in an overhead view in FIG. 6 and in FIG. 7 in a section along the line VII-VII from FIG. 6. As in the embodiments depicted in FIGS. 3 to 5, the partition wall features a plurality of air passage openings 30 and a plate 40*a* or 40*b* bearing a fleece 50 (see FIG. 6) can, as shown in FIG. 6 using the left-hand plate 40*a* as an example, assume a position in which it lies flat on the partition wall 29 in which the openings 31 of the plate 40*a* coincide with those of the partition wall 29. Ramps 53 are formed on bars 38 extending in the downwards direction of the carcass 1 rising towards the rear wall 8. Pins 51 projecting from the plates 40*a*, 40*b* lie in each case for the left-hand plate 40*a* at the foot of the ramps 53.

Coupled for example by an electric motor not shown in the figure, rotatable control elements 42 each comprise a base plate 43 and an eccentric projection raised from it, here in the form of a circle sector shaped rib 52. If the rotation of the control element 42 causes the rib 52 to press against the plate 40*a* or 40*b*, as shown by the example of the right-hand plate 40*b* in FIG. 6, this is pressed backwards in the direction of the air inlet opening 37, in which case the pins 51 slide onto the ramp 53 and thereby lift the plate 14. A space is thus produced between the plate 40 and the partition wall 29 through which air can travel from the air inlet opening 37 directly to the openings 30 of the partition wall 29, without its flow being attenuated by the fleece 50. The effects obtained by this are the same as for the embodiment described above.

The fact that the ribs 52 of the control element 42 are set at a suitable angle to each other means that four states can also be set here, in which either the two plates 40*a*, 40*b* rest on the partition wall 29, one plate rests on the wall in each case and the other is raised, or both plates 40 are raised.

By contrast with the diagrams depicted in FIGS. 6 and 7, it is also possible to omit the ramp adjacent to the door 2, i.e. the upper ramp shown in the diagram of FIG. 6 or the left-hand ramp 45 shown in the diagram of FIG. 7, from the ramps 53. This leads to the plates 40*a*, 40*b* each being able to be moved between the position shown in FIG. 7 resting against the partition wall 29 and an offset position in which in each case only the edge of a plate 40*a*, 40*b* adjacent to the air inlet opening 37 is lifted away from the partition wall 29, whereas the edge of the plate close to the door continues to rest on the wall. Thus, as depicted in the embodiment in FIG. 3, a wedge-shaped intermediate area is formed in each case between plate 40 and partition wall 29 which drives the air flowing in from the air inlet opening 37 onto the partition wall 29.

Diverse variations and developments of the exemplary embodiments described here are possible. Thus for example the rotatable control elements 42 can be replaced by ramps which move in a linear manner or other drive mechanisms for the movement of the plates 40*a*, 40*b* can be provided.

To adapt the position of the plates 40*a*, 40*b* at any time to the cooled items stored in the assigned pull-out drawers 7, a user interface can be provided at which a user—by selecting from a displayed menu for example—can specify the type of the cooled item stored in each pull-out drawer, and an electronic control circuit selects on the basis of an assignment table the position of the plates 40*a*, 40*b* appropriate for the respective cooled items and sets this position.

The invention claimed is:

1. A refrigerating device comprising:

an evaporator;

at least one compartment;

an air circulation path along which air cooled by the evaporator is circulated between the compartment and the evaporator, the air circulation path including an air flow area adjacent the compartment;

a wall between the compartment and the air flow area, the wall having a plurality of air passage openings through which air passes from the air flow area into the compartment; and a diffusion layer, the diffusion layer being disposable between a first position in which it diffuses air flowing from the air flow area into the air passage openings in the wall and a second position in which the diffusion layer is disposed such that air can flow from the air flow area into the compartment while bypassing the diffusion layer.

2. The refrigerating device as claimed in claim 1, wherein the air flow area is located upstream from the diffusion layer in the direction of flow of the air and is configured as an air distribution chamber.

3. The refrigerating device as claimed in claim 1, wherein the diffusion layer is a mat made from fiber material.

4. The refrigerating device as claimed in claim 1, wherein the diffusion layer is configured as a moisture filter.

5. The refrigerating device as claimed in claim 1 and further comprising an air inlet opening formed in a wall of the air flow area adjacent to the wall and the diffusion layer in the second position is offset from the wall.

6. The refrigerating device as claimed in claim 1, wherein the diffusion layer is attached to a movable frame.

7. The refrigerating device as claimed in claim 6, wherein the frame includes openings that, in the first position of the diffusion layer, substantially coincide with the air passage openings in the wall.

8. The refrigerating device as claimed in claim 6, wherein the frame is movable about an axis.

9. The refrigerating device as claimed in claim 6, wherein the frame is moved on a ramp aligned at an angle to the wall.

10. The refrigerating device as claimed in claim 6, wherein an actuation section of the frame is adjustable by at least one movable ramp.

11. The refrigerating device as claimed in claimed 10 and further comprising a motor for driving each movable ramp.

12. The refrigerating device as claimed in claim 11 and further comprising a control device having a user interface for specifying a type of cooled item stored in each compartment and configured to select a position of the diffusion layer as a function of the type of cooled item.

13. The refrigerating device as claimed in claim 1 and further comprising at least two frames, each having a diffusion layer and each being associated with a movable ramp operable to move the respective diffusion layer between the first and second positions, and the ramps are rigidly connected to one another.

14. The refrigerating device as claimed in claim 13, wherein the ramps are arranged on a circular track and the circular track is configured to allow rotation.

15. The refrigerating device as claimed in claim 1 and further comprising a second compartment and a second diffusion layer associated with the second compartment that can be moved independently of the diffusion layer associated with the first compartment between the first and the second position.

* * * * *

UNITED STATES PATENT AND TRADEMARK OFFICE

CERTIFICATE OF CORRECTION

PATENT NO. : 8,256,237 B2
APPLICATION NO. : 12/525567
DATED : September 4, 2012
INVENTOR(S) : Thomas Bischoffberger et al.

It is certified that error appears in the above-identified patent and that said Letters Patent is hereby corrected as shown below:

Title page, Item (73) Assignee should read: BSH Bosch and Siemens Hausgeraete GmbH, Munich (DE) and Miele & Cie. KG, Gütersloh (DE)

Signed and Sealed this
First Day of January, 2013

David J. Kappos

David J. Kappos
*Director of the United States Patent and Trademark Office*